US005647252A

United States Patent [19]

Miner

[11] Patent Number: 5,647,252

[45] **Date of Patent: *Jul. 15, 1997**

[54] REVERSIBLE RATCHETS

[76] Inventor: Montie H. Miner, 2205 Robert, Granite City, Ill. 62040

[ * ] Notice: The term of this patent shall not extend beyond the expiration date of Pat. No. 5,450,773.

[21] Appl. No.: 302,219

[22] Filed: Sep. 8, 1994

[51] Int. Cl.[6] ..... B25B 13/46

[52] U.S. Cl. ..... 81/62; 81/63.1; 81/124.3

[58] Field of Search ..... 81/60, 61, 62, 81/63.1, 58.4, 124.3

[56] References Cited

U.S. PATENT DOCUMENTS

| | | | |
|---|---|---|---|
| 2,570,779 | 10/1951 | Dodge | 81/62 |
| 2,963,929 | 12/1960 | Barnes | 81/62 |
| 3,241,409 | 3/1966 | Raptis | 81/124.3 |
| 3,299,750 | 1/1967 | Campanile | 81/62 |
| 4,324,158 | 4/1982 | Le Roy | 81/60 |
| 4,328,720 | 5/1982 | Shiel | 81/63 |
| 4,602,534 | 7/1986 | Moetteli | 81/177.85 |
| 4,817,475 | 4/1989 | Kelly | 81/121 |
| 4,939,961 | 7/1990 | Lee | 81/60 |
| 4,993,288 | 2/1991 | Anderson | 81/57.39 |
| 5,048,379 | 9/1991 | Gramera | 81/124.4 |
| 5,058,463 | 10/1991 | Wannop | 81/62 |

FOREIGN PATENT DOCUMENTS

| | | | |
|---|---|---|---|
| 306364 | 3/1933 | Italy | 81/125 |
| WO94/14574 | 7/1994 | WIPO | 81/60 |

*Primary Examiner*—D. S. Meislin
*Assistant Examiner*—Joni B. Danganan

[57] ABSTRACT

The invention relates to reversible manually operated ratchets in which a yoke provided with separated pawl containing chambers is secured in a handle, a toothed gear and a reverse button are rotatably disposed in a large bore in the yoke and secured therein between opposing ears of the handle, separated pawls each pivotally mounted in the yoke are spring biased toward the teeth in the gear, a hexagonal chamber containing latching means in the gear secures a through hole socket open at both ends, and control faces on the periphery of the reverse button allow preselected pawl or neither pawl access to the toothed gear.

5 Claims, 5 Drawing Sheets

REVERSIBLE RATCHETS

This invention relates to manually operated ratchets.

Most hand ratchets in use today employ sockets which are secured at one end about a driving post and are thus limited to driving nuts on threaded members having a finite length. These tools are limited to applications where the length of the threaded member to which the nuts are being attached does not exceed the depth of the socket. Applicant is co-inventor of an invention for which there has been filed and is now pending before the Patent Office an application for Letters Patent on a "through hole" socket which is open at both ends and may be used to selectively tighten and remove threaded fasteners on threaded shafts, irrespective of the length of the shaft. That separate patent application filed Mar. 11, 1994, now pending, bears Ser. No. 08/208,680, and is entitled POWER TOOL SOCKETS.

Prior to the advent of the through hole power ratchet, sockets were connected to the ratchets by driving posts, over which one end of the socket was disposed. These posts were frequently provided with spring-loaded balls which were urged into depressions in the sockets to hold the socket about the post during driven rotation. With the advent of the through-hole ratchet, this type of attaching means is no longer suitable, and a need exists for a ratchet-to-socket retention device and retention method suitable for use in manually operated ratchets for through-hole applications.

It is the object of this invention to provide a reversible hand ratchet which will hold a through-hole socket secured in the ratchet during rotation thereof, which permits ready interchange between sockets of different sizes, and which provides a unique and novel pawl system which has maximum torque efficiency with minimum wear.

IN THE DRAWINGS

DESCRIPTION

Figure 1:
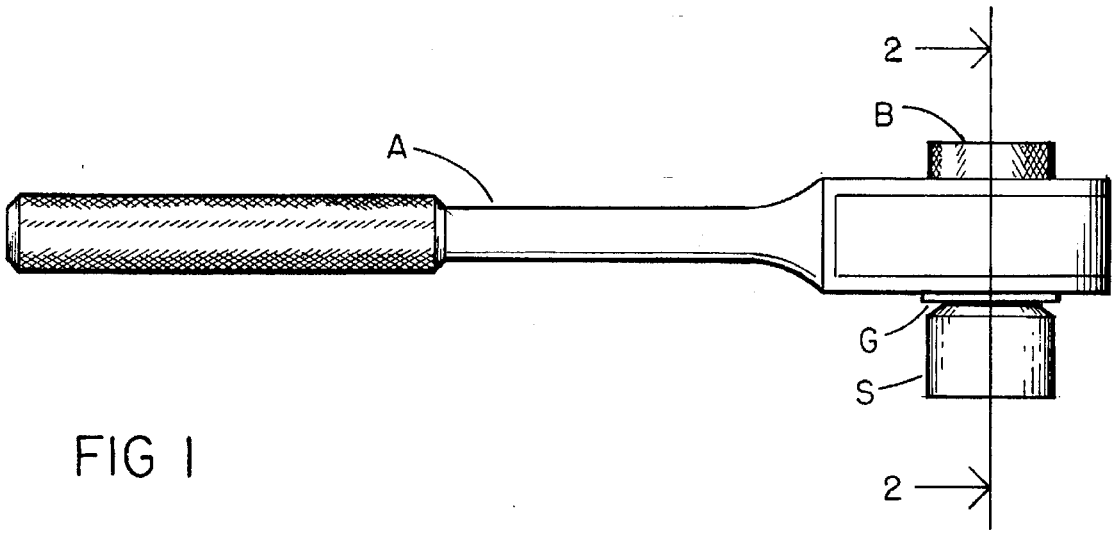
FIG. 1 is an elevation view of a preferred embodiment of my ratchet.
Figure 2:
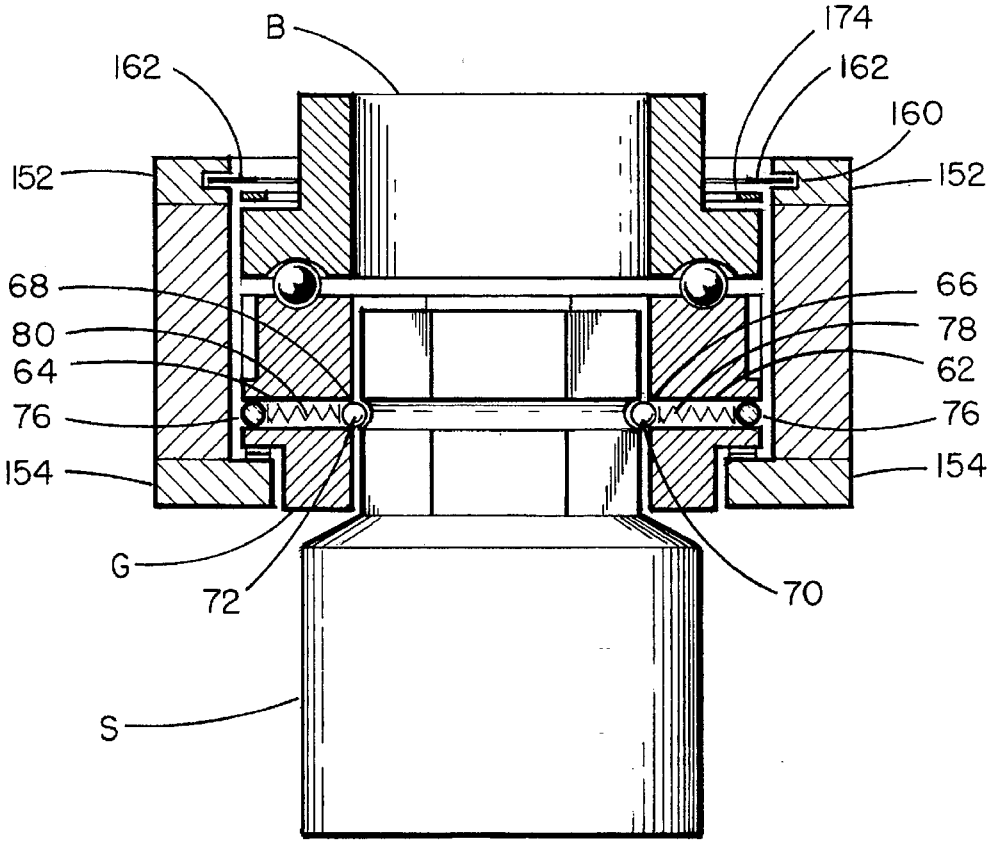
FIG. 2 is a section view along lines 2—2 of FIG. 1.
Figure 3:
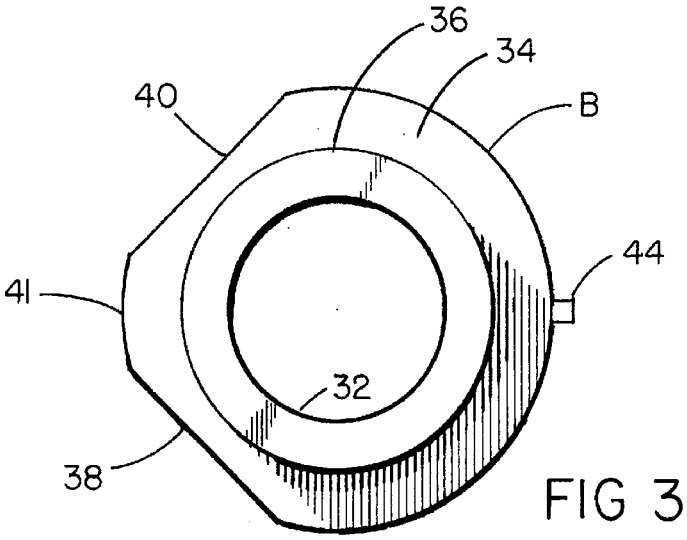
FIG. 3 is a top plan view of reverse button B.
Figure 4:
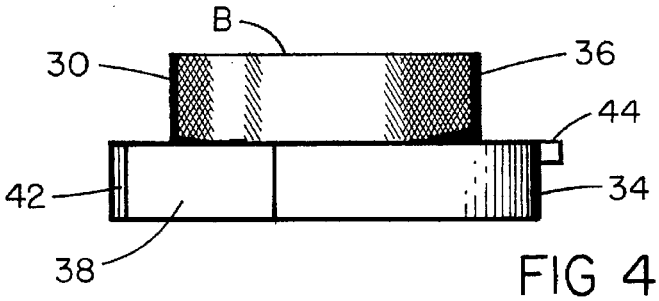
FIG. 4 is a side view of reverse button B.
Figure 5:
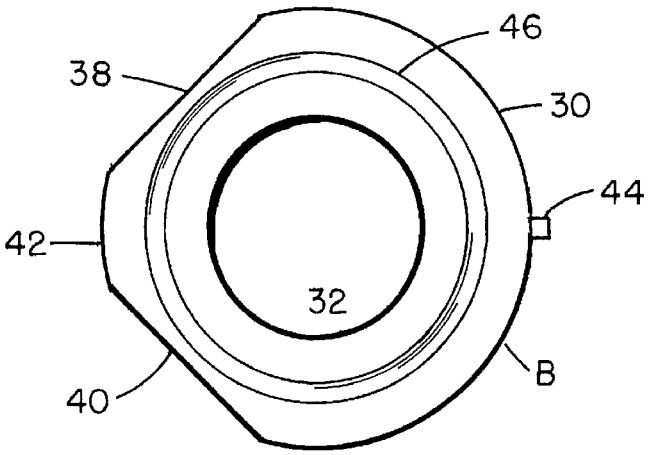
FIG. 5 is a bottom view of reverse button B.
Figure 7:
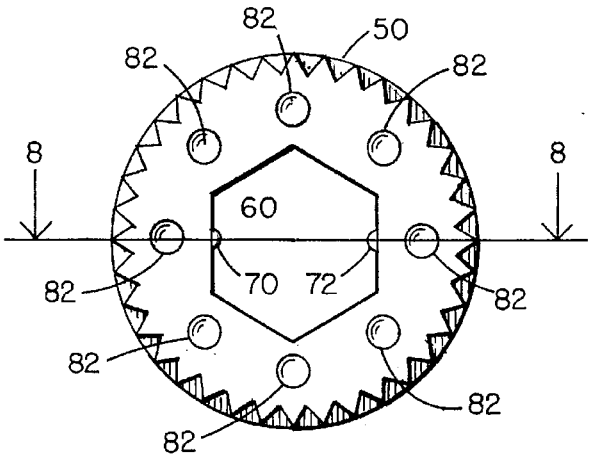
FIG. 7 is a bottom view of drive gear G.
Figure 8:
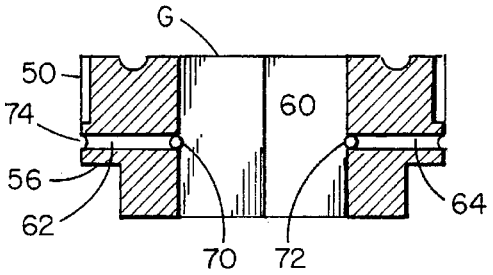
FIG. 8 is a section view along lines 8—8 of FIG. 7.
Figure 9:
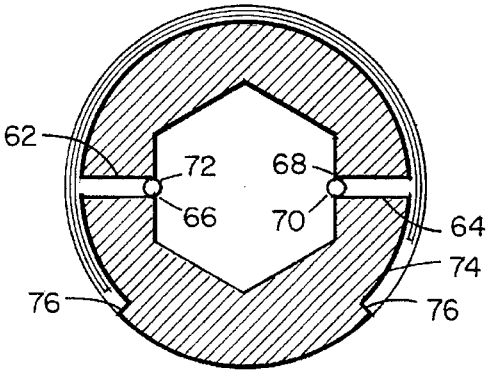
FIG. 9 is a section view along lines 9—9 of FIG. 6.
Figure 6:
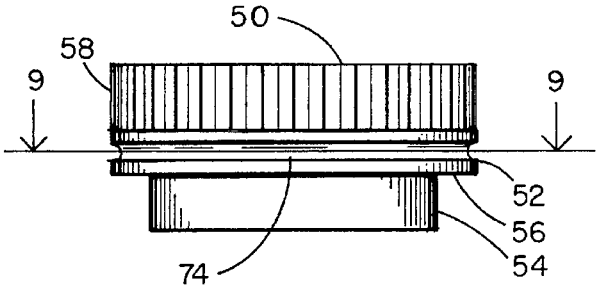
FIG. 6 is side elevation view drive gear G.
Figure 10:
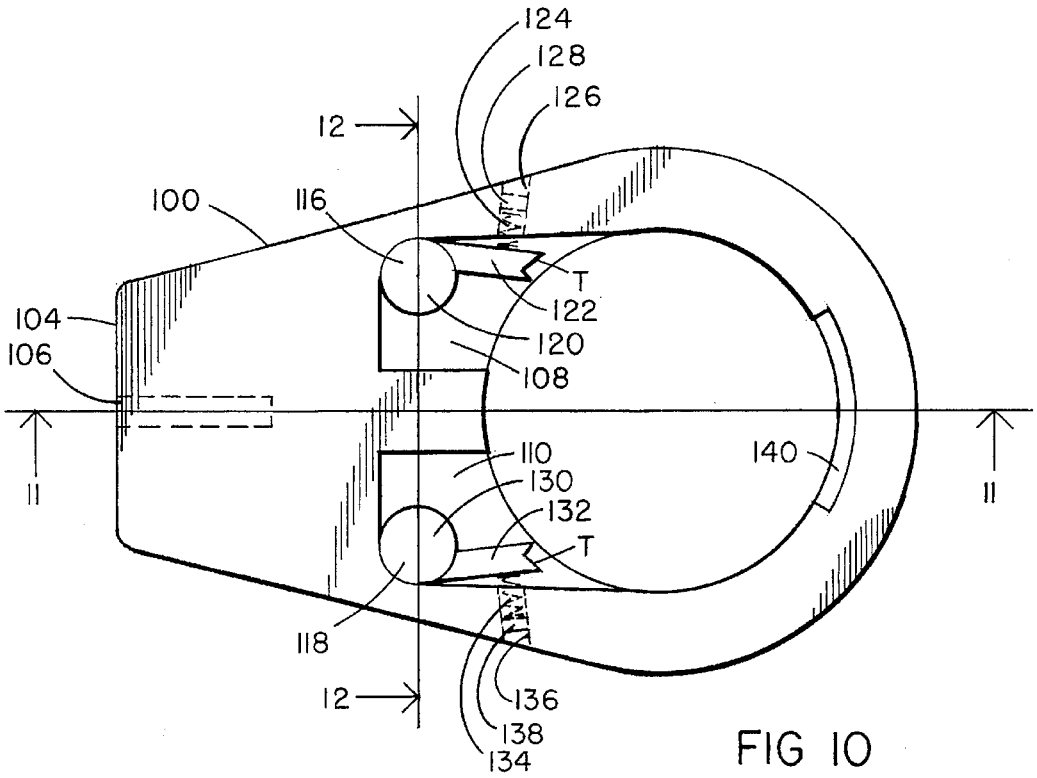
FIG. 10 is a top plan view of yoke Y.
Figure 11:
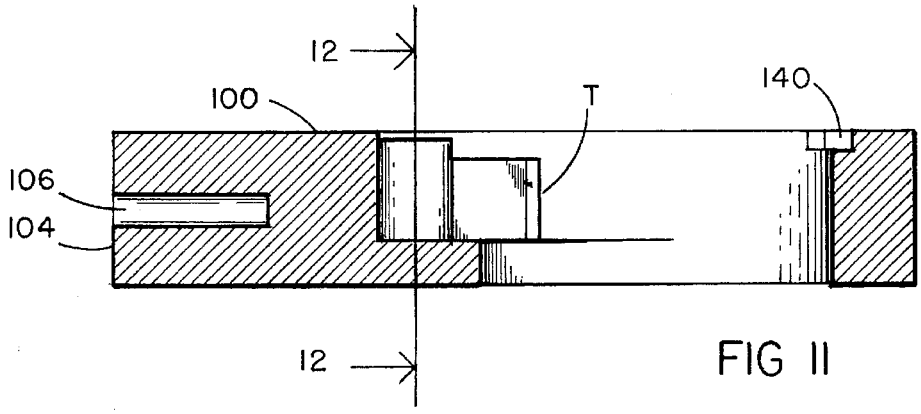
FIG. 11 is a section view along lines 11—11 of FIG. 10.
Figure 12:
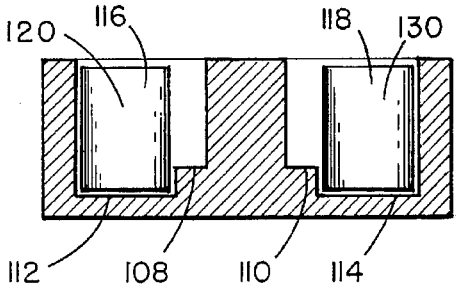
FIG. 12 is a section view along lines 12—12 of FIG. 10.
Figure 13:
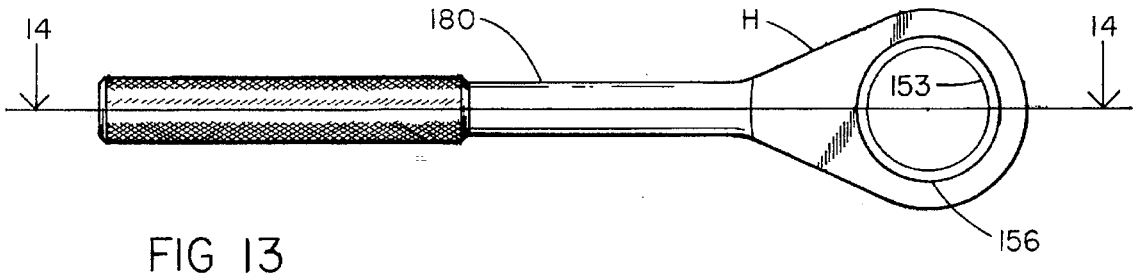
FIG. 13 is a top plan view of the handle H.
Figure 14:
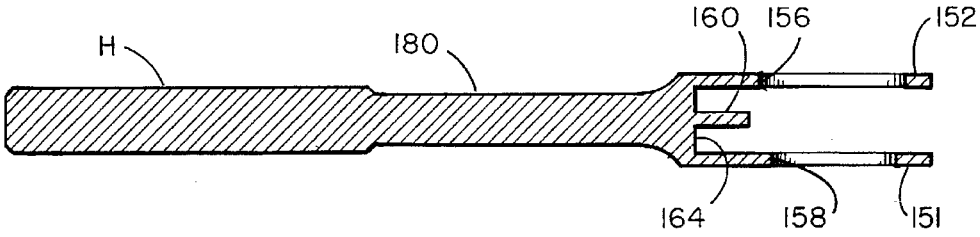
FIG. 14 is a section view along lines 14—14 of FIG. 13.

Referring now in more detail, and by reference character to the drawings which illustrate a preferred embodiment of our invention, A designates a reversible ratchet tool comprising a yoke Y mounted in a handle H and containing a driven gear G and reverse button B rotatably disposed therein.

The reverse button B comprises an annular shell 30 having an central aperture 32 which extends completely therethrough, a large annular element 34, and a selector knob 36. The element 34 includes on its periphery two spaced flat control faces 38, 40, separated by a segment 42. Located on the periphery of the element 34 diametrically opposed to the segment 36 is a rotational limiting bar 44, for purposes presently more fully to appear. The base 34 of the reverse button B is provided with an annular race 46.

The drive gear G comprises a shell 50 including two coaxial cylindrical sections 52, 54, having markedly different diameters, and an annular shoulder 56 which is perpendicular to the common axis of the sections 52, 54. The larger section 52 is provided on its outer periphery with a plurality of uniformly spaced aligned gear teeth 58. The center of the shell 50 comprises a hexagonal chamber 60 which extends along the common axis of the sections 52, 54. A pair of opposing bores 62, 64, extend radially inwardly and are narrowed at respective inner ends 66, 68, so that bearings 70, 72, disposed in the bores 62, 64, will be retained in the bores 62, 64, but can also be partially extended into the chamber 60. An extended notch 74 is located on the periphery of the smaller section 54 in registration with the bores 62, 64, and an arcuate spring 76 disposed in the notch 74 holds biasing springs 78, 80, in the bores 62, 64, respectively so that the respective bearings 70, 72, are biased toward and extend into the chamber 60.

One face 82 of the gear G at the larger section 52 is flat and provided with a plurality of spaced hemispherical recesses 84 each adapted to receive a ball bearing 86. The face 88 of the smaller section 54 is flat.

The yoke Y comprises a block 100 having substantial thickness and provided at one end with a round bore 102 sized slightly larger in diameter than the drive gear G and reverse button B. Yoke Y includes a flat base 104 having a bore 106 which extends from the base 104 toward the bore 102. Adjacent the bore 102 and providing access thereto, are spaced complementary chambers 108, 110, each respectively provided with an annular recess 112, 114, in which are pivotally mounted pawls 116, 118, respectively.

The pawl 116 includes a cylindrical element 120 and a blade 122. The cylindrical element 120 is longer than the blade 122 so that the blade 122 is free to pivot when the longer end of the element 120 is seated in the recess 112. A spring 124, disposed in a bore 126 in the block 100 and held therein by a set screw 128 biases the blade 122 toward and into the bore 102.

Similarly, the pawl 118 includes a cylindrical element 130 and a blade 132. The cylindrical element 130 is longer than the blade 132 so that the blade 132 is free to pivot when the longer end of the element 130 is seated in the recess 114. A spring 134, disposed in a bore 136 in the block 100 and held therein by a set screw 138 biases the blade 132 toward and into the bore 102.

It should be here noted that the blades 122, 132, are each respectively provided at their outer ends with a plurality of teeth T sized for meshing engagement with the gear teeth 58 when the pawls 116, 118, are urged into the bore 102 by their respective springs 124, 134.

It should also be noted that the annular race 46 and the ball bearing recesses 84 are in annular registration with each other about the common axis of the sections 52, 54, and the control faces 38, 40 are separated on the periphery of the reverse button B by a distance such that when the control face 38 spans the chamber 108, the spring 124 will urge the blade 122 of the pawl 116 into the bore 102 and into meshing engagement with the gear teeth 58 while at the same time the periphery of the button B prevents the blade 132 of the pawl 118 from extending into the bore 102. Conversely, when the control face 40 spans the chamber 110, the spring 134 urges the blade 132 of the pawl 116 into the bore 102 and into meshing engagement with the gear teeth 58 while the periphery of the button B spans the gap across the chamber 108 blocking the pawl 116 from entering the bore 102.

On its upper face along the bore 102 at a location diametrally opposed to the wall separating the chambers 108, 110, the block 100 of the yoke Y is provided with a recess 140 sized for accepting the rotational limiting bar 44 of the button B and for allowing, when the button B is mounted in the yoke Y, rotational movement of the button B selectively between one position where the flat face 38 spans the chamber 108 to the other position where the flat face 40 spans the chamber 110.

The handle H comprises a long rounded shaft 150 and a pair of spaced ears 152, 154, each respectively provided with bores 156, 158. Bore 156 in ear 152 is annular and diametrally sized slightly larger than the smaller section 54 of the gear G so that when the smaller section 54 of the gear G is passed into the bore 156 of the ear 152, the gear G will be free to rotate therein. Bore 158 in ear 154 is sized slightly larger than the outer diameters of the gear G and reverse button B so that both the gear G and reverse button B may be inserted between the ears 152 and 154 during assembly. A slot 160 sized for acceptance of a snap ring 162 is located in the periphery of the bore 156 in the ear 152.

Intermediate the shaft 150 and ears 152, 154, the handle H includes a flat section 164 having an elongated post 166 centrally located thereon. The ears 152,154, and flat section 164 are sized and shaped for snug fitting acceptance of the yoke Y when the yoke is positioned in the handle H with its flat section 104 presented to the flat section 164 and its bore 106 disposed about the post 166.

ASSEMBLY

The ratchet A is assembled by first by first sliding the bore 106 of the yoke Y onto the post 166 in such manner that the flat sections 164 and 104 abut, in which position the bore 102 of the yoke Y will be in registration with the bore 156 of the handle H. Thereafter, a wafer spring 170 is placed on the smaller cylindrical section 54 of the gear G and the cylindrical section 54 is then passed through the smaller bore 158 in the handle H wherein the wafer spring 170 becomes confined between the ear 154 and the annular shoulder 56. Next, ball bearings 86 are placed in the recesses 84 and the reverse button B is placed in the bore 156 of the yoke Y with the race 46 overlapping and holding in registration the bearings 86, and the rotational limiting bar 44 of the button B disposed in the recess 140 of the yoke Y in such manner that the bar 44 is substantially in the center of the recess 140, in which position neither of the faces 38, 40, will fully span the chambers 108, 110, and the blades 122, 124, of the pawls 116, 118, will be held away from the bore 102 during assembly. Assembly is completed by pushing the button B toward the ear 152 compressing the wafer spring 170, placing a high friction washer 174 on the button B around the knob 36, and thereafter securing the assembly by inserting snap ring 162 into the slot 160.

OPERATION

Operation of the ratchet is conventional. Sockets S provided with centrally located external annular notches 180 (similar to those described in copending application Ser. No. 08/208,680 entitled Power Tool Sockets) are inserted into the hexagonal chamber 60 where the latching bearing 70, 72 engage the notch 180 holding the socket S in place. If the socket S is to be driven in a clockwise direction, the reverse button B is rotated clockwise causing the control face 40 to span the chamber 110 in which position the teeth T on the blade 132 will be urged into engagement with the teeth 58 of the gear as the ratchet A is rotated clockwise. Conversely, if the socket S is to be driven in a counterclockwise direction, the reverse button B is rotated counterclockwise causing the control face 38 to span the chamber 108 in which position the teeth T on the blade 122 will be urged into engagement with the teeth 58 of the ear G as the ratchet A is rotated counterclockwise.

Having thus described my invention, what I seek and desire to secure by Letters Patent is shown in the drawings, described in the specification and claimed in the following claims:

What is claimed is:

1. A reversible hand ratchet comprising a handle, a yoke secured at one end to said handle, a reverse button and a drive gear, said handle comprising a pair of ears in spaced parallel relation at the end of an elongated shaft, each ear being provided with an annular aperture which is coaxial with the aperture on the complimentary ear, said handle also including a centrally located post which is located between and extends parallel with the ears, the aperture in the first ear being diametrically larger than the aperture in the second ear, said yoke being disposed on the post between the first and second ears and having a large bore sized substantially the same size as the larger ear aperture and coaxial therewith, said yoke also including first and second pawls pivotally mounted in first and second spaced chambers which have access to the large bore, each pawl being sized for extension into the large bore during pivotal movement, said drive gear comprising a shell including first and second cylindrical members of different diameters separated by an annular shoulder and also including a central aperture shaped for receiving a socket having a plurality of flat exterior faces, said drive gear also being provided with a band of spaced teeth in axial registration about the periphery of the larger cylindrical member and socket retaining means for removably securing a socket in the central aperture during rotation of the drive gear, said socket retaining means comprising an annular notch in the periphery of the larger member, a clip disposed in said notch, first and second bores on opposing sides of the central aperture extending from the notch toward the central aperture, a ball disposed in each of said bores, and spring means disposed between the clip and each of said balls for urging said balls toward the central aperture, said first and second bores each being diametrically reduced at the central aperture to retain the balls in said bores while said balls are urged into the central aperture by the spring means, said second member being diametrically sized for free moving disposition in the ear having the aperture with the smaller diameter whereby the drive gear may be rotatably retained in the bore of the yoke by the first ear at the annular shoulder, said reverse button including a cylindrical shell comprising third and fourth cylindrical members and a central annular bore, said third member being diametrically sized slightly smaller than the bore in the yoke and the fourth member being sized substantially smaller in diameter than the third member, said reverse button also including selector means for selectively allowing the first pawl to extend into the bore of the yoke while simultaneously blocking the second pawl from extending into said bore when the reverse button is in one position, and for conversely allowing the second pawl to extend into the bore of the yoke while simultaneously blocking the first pawl from extending into said bore when the reverse button is in a second position, said selector means including a flat area on the periphery of the third member, bearing means disposed between the reverse button and the drive gear for allowing the drive gear to be rotatably driven in either direction while the reverse button remains stationary, and releasable retaining means for holding the yoke between the ears of the handle and the drive gear, bearing means and reverse button snugly together in the bore of the yoke during operation of the hand ratchet.

2. The ratchet of claim 1 wherein the reverse button is provided with a positioner and the yoke is provided with slot means adapted for receiving the positioner and holding the flat area on the reverse button in fixed position with respect to the selected chamber containing the pawl.

3. A reversible hand ratchet comprising a handle, a yoke secured at one end to said handle, a reverse button and a drive, said handle comprising a pair of ears in spaced parallel relation at the end of an elongated shaft, each ear being provided with an annular aperture which is in coaxial registration with the other aperture, the other end of said yoke being disposed between the first and second ears and including a bore sized substantially the same size as the first ear's aperture and being coaxial therewith, said yoke also including first and second pawls, each pivotally mounted in the yoke between the ears and each sized for projection into the bore during some portion of its pivotal movement, biasing means for urging the end of each pawl toward the bore, said drive comprising an annular hollow shell including an axially extending central bore shaped for receiving a socket having at least one flat exterior face, said drive also being provided with a plurality of spaced teeth in axial registration about its periphery and latching means for retaining said socket in the central bore during rotation of the drive, said reverse button also being disposed in the bore of the yoke between the first and second ears and including reversing means for selectively holding one of the pawls away from the teeth in the drive gear while simultaneously allowing the other pawl to be urged into engagement with the spaced teeth by the biasing means, bearing means disposed between the reverse button and the drive for allowing the drive gear to be rotated independently of the reverse button, and means for holding the reverse button in its preselected position while the drive is being rotated, said latching means comprising a clip disposed in a notch on the periphery of the drive, first and second bores on opposing sides of the drive extending from the peripheral notch toward the central bore of the drive, said first and second bores each being diametrically reduced at the junction of said bore with the central bore, a ball disposed in each of said bores, and spring means disposed between the clip and each of said balls for urging a portion of said balls into the central bore.

4. The ratchet of claim 3 wherein the reversing means comprises a flattened sector on its periphery sized to allow a pawl to which it is presented to be urged into engagement with the teeth on the drive by the biasing means while the other pawl is held away from engaging said teeth by the periphery of the reversing means, and wherein the reversing means also includes on its periphery a post which extends into a complementary slot in the yoke sized for receiving the post.

5. A reversible hand ratchet comprising a handle, a yoke secured at one end to the handle, a reverse button and a drive gear, said handle comprising a pair of ears in spaced parallel relation at the end of an elongated shaft, the first ear having a first aperture and the second ear having a second aperture which is larger than the first aperture, the first and second apertures being annular and coaxial, said yoke being disposed between the first and second ears and including a bore sized substantially the same size as the first aperture and being coaxial therewith, said yoke also including first and second pawls, each pivotally mounted in the yoke between the ears and each sized for projection into the bore during pivotal movement, said drive gear comprising a hollow shell including first and second cylindrical elements of different diameters separated by an annular shoulder and a central aperture shaped for receiving a socket having at least one flat exterior face, said drive gear also including a plurality of spaced teeth in axial registration about the periphery of the first element and socket retaining means for holding sockets in the central aperture during rotation of the drive gear, said second element being diametrically sized slightly smaller than the first aperture whereby the drive gear may be rotatably retained in the bore of the yoke by the first ear, said reverse button including a cylindrical shell comprising third and fourth cylindrical elements and a central annular bore, said third element being diametrically sized slightly smaller than the bore of the yoke and the fourth element being sized substantially smaller in diameter than the third element, said reverse button also including selector means for selectively allowing either the first or second pawl to extend into the bore of the yoke while simultaneously preventing the other pawl from extending into said bore, bearing means disposed between the reverse button and the drive gear for allowing the drive gear to be rotatably driven in either direction while the reverse button remains stationary, and releasable retaining means for holding the yoke between the ears of the handle and the drive gear, bearing means and reverse button snugly together in the bore of the yoke during operation of the ratchet, said socket retaining means of the drive gear comprising an annular notch in the periphery of the first element, an annular band disposed in said notch, first and second complimentary bores on opposing sides of the central aperture extending from the peripheral notch toward the central aperture, a ball disposed in each of said bores, and spring means disposed between the band and each of said balls for urging said balls toward the central aperture, the diameter of said first and second bores being diametrically reduced adjacent the central aperture for retaining the balls in said bores while portions of said balls are urged into the central aperture.

* * * * *